US011004432B1

(12) United States Patent
Chen

(10) Patent No.: US 11,004,432 B1
(45) Date of Patent: May 11, 2021

(54) DRUM STAND COUPLER AND DRUM USING THE SAME

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 16/878,082

(22) Filed: May 19, 2020

(51) Int. Cl.
*G10D 13/00* (2020.01)
*G10D 13/10* (2020.01)
*G10D 13/22* (2020.01)

(52) U.S. Cl.
CPC ..... *G10D 13/28* (2020.02); *G10D 13/22* (2020.02)

(58) Field of Classification Search
CPC ..... G10D 13/28; G10D 13/22
See application file for complete search history.

(56) References Cited

U.S. PATENT DOCUMENTS

2011/0030530 A1* 2/2011 Schafer ..... G10G 5/005 84/421
2014/0026734 A1* 1/2014 Sato ..... G10D 13/065 84/421

* cited by examiner

*Primary Examiner* — Kimberly R Lockett
(74) *Attorney, Agent, or Firm* — Muncy, Geissler, Olds & Lowe, P.C.

(57) ABSTRACT

A drum stand coupler is provided, including: a fixing mechanism and a connecting mechanism. The fixing mechanism is configured to be disposed on a drum body. The connecting mechanism is rotatably connected with the fixing mechanism and configured to be assembled with a stand. A drum using the drum stand coupler as described above is further provided, further including: the drum body. An interconnection of the fixing mechanism and the connecting mechanism defines a rotating axis about which the connecting mechanism is rotatable, and the rotating axis is transverse to an axial direction of the drum body.

11 Claims, 5 Drawing Sheets

DRUM STAND COUPLER AND DRUM USING THE SAME

BACKGROUND OF THE INVENTION

Field of the Invention

The present invention relates to a drum stand coupler and a drum using the same.

Description of the Prior Art

Generally, a drum assembly includes a plurality of drums which are connected with one another or with stands by drum stand couplers for easy operation. A conventional drum stand coupler is directly screwed on a drum hoop or a drum shell of a drum and then connected to another drum or a stand for stable connection. However, when the drum is beaten, the vibration of the drum is easy to be absorbed or offset since the drum hoop or the drum shell is fixedly connected with the drum stand coupler, which results in poor resonance effect of the drum and affects timbre or loudness of the drum.

The present invention is, therefore, arisen to obviate or at least mitigate the above-mentioned disadvantages.

SUMMARY OF THE INVENTION

The main object of the present invention is to provide a drum stand coupler and a drum using the same for stable connection and good resonance effect.

To achieve the above and other objects, the drum stand coupler of the present invention includes: a fixing mechanism and a connecting mechanism. The fixing mechanism is configured to be disposed on a drum body. The connecting mechanism is rotatably connected with the fixing mechanism and configured to be assembled with a stand.

To achieve the above and other objects, the drum using the drum stand coupler as described above is further provided, further including: the drum body. An interconnection of the fixing mechanism and the connecting mechanism defines a rotating axis about which the connecting mechanism is rotatable, and the rotating axis is transverse to an axial direction of the drum body.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
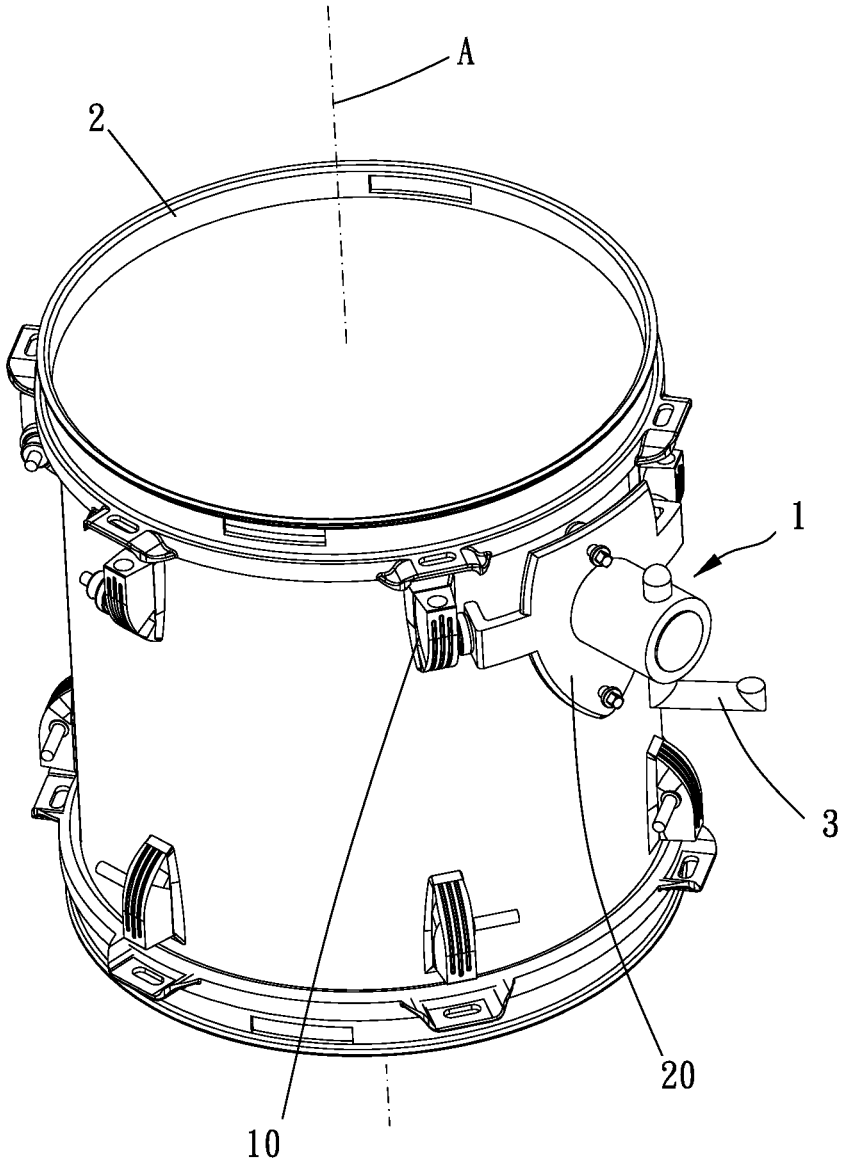
FIG. 1 is a stereogram of a preferable embodiment of the present invention.
Figure 3:
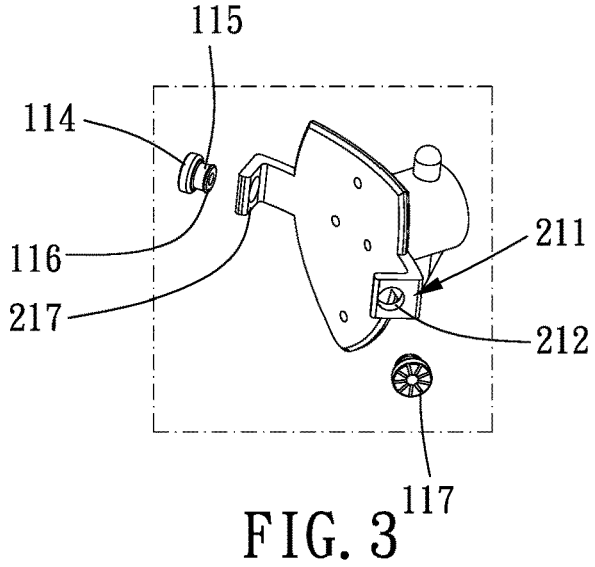
FIG. 3 is a partial breakdown drawing of a drum stand coupler of FIG. 2 as viewed from another side.
Figure 2:
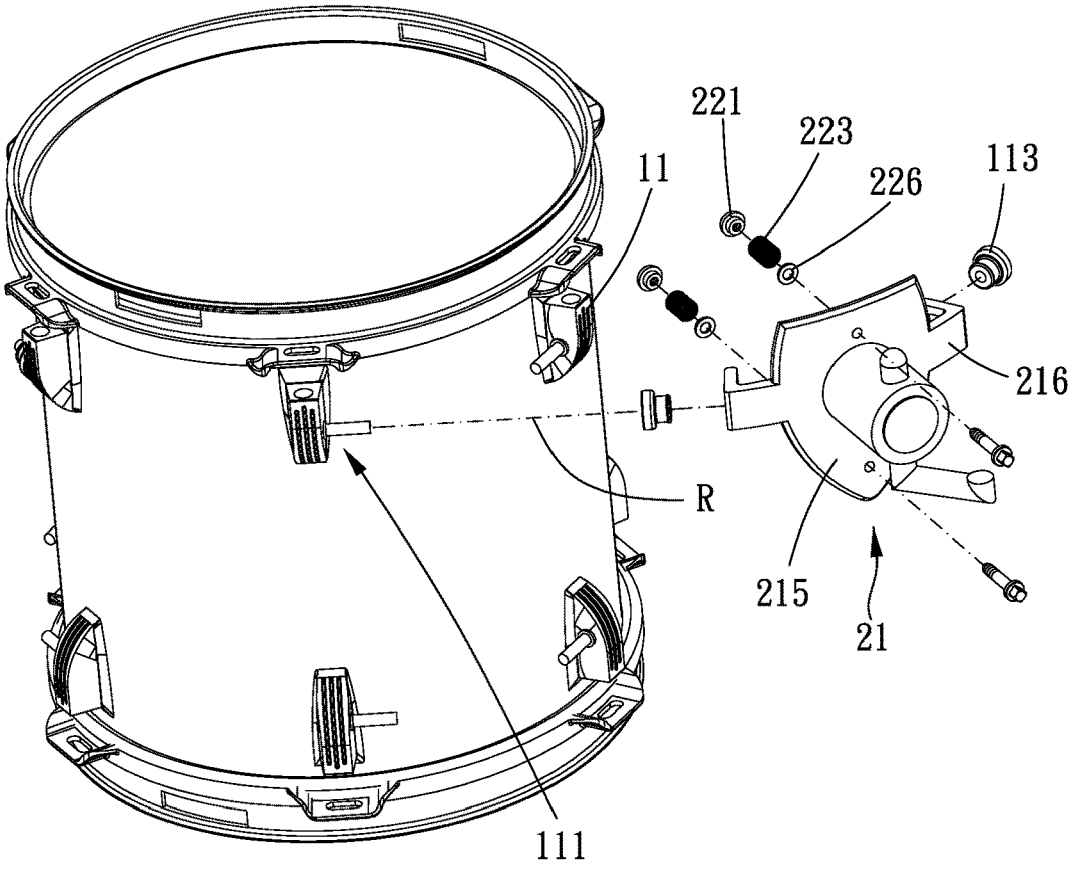
FIG. 2 is a breakdown drawing of a preferable embodiment of the present invention.
Figure 4:
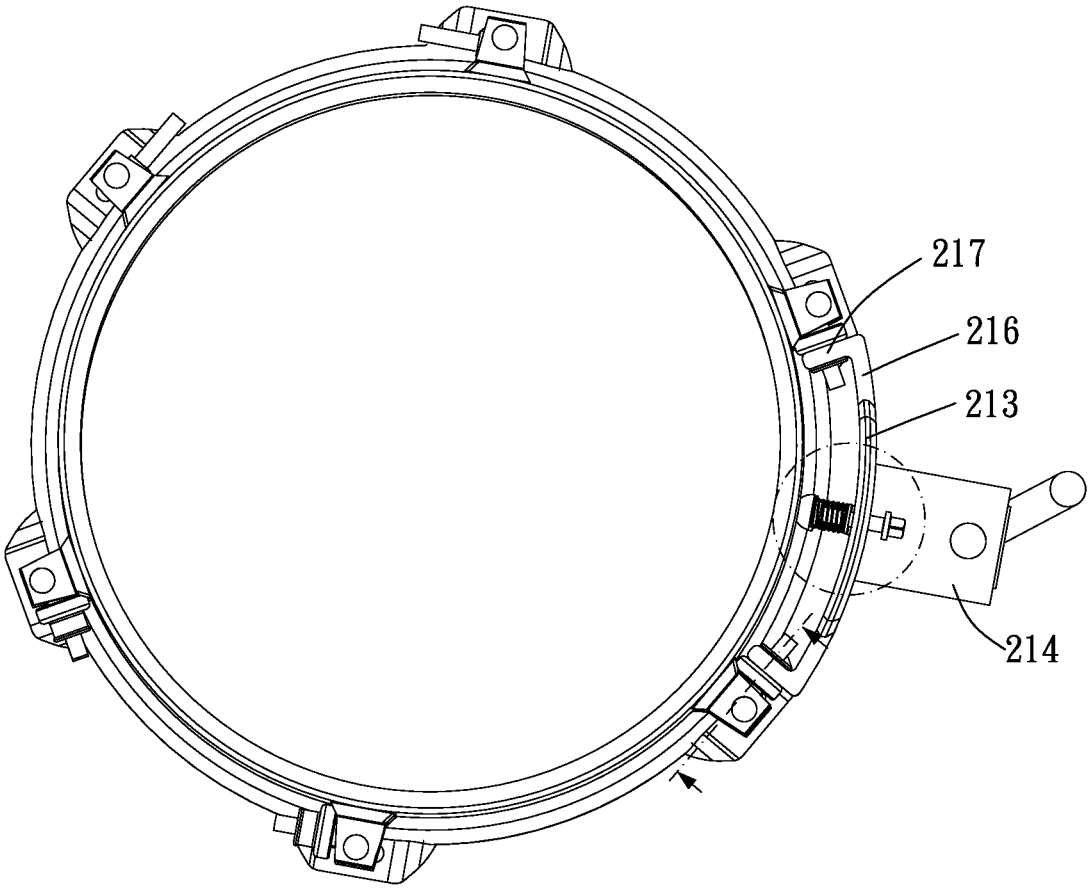
FIG. 4 is a top view of a preferable embodiment of the present invention.
Figure 5:
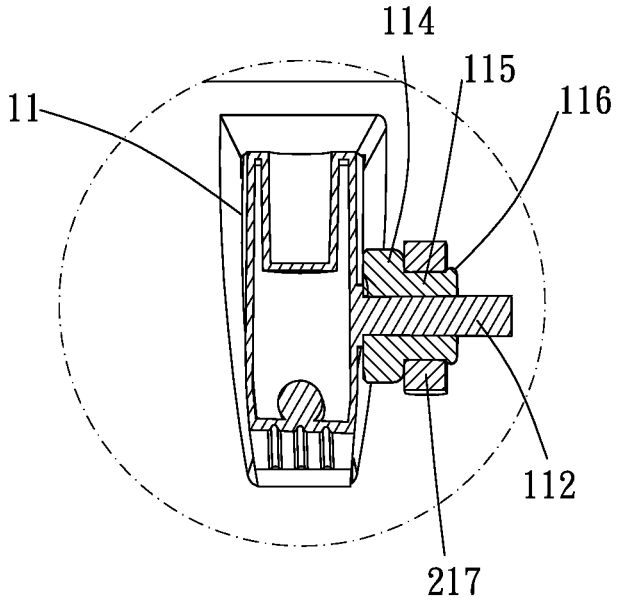
FIG. 5 is a partial cross-sectional view of FIG. 4.
Figure 6:
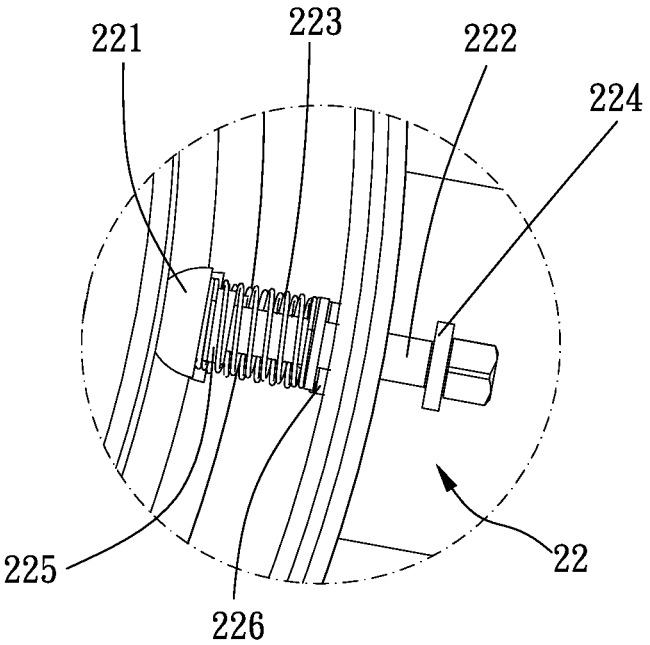
FIG. 6 is a partial enlargement of FIG. 4.
Figure 7:
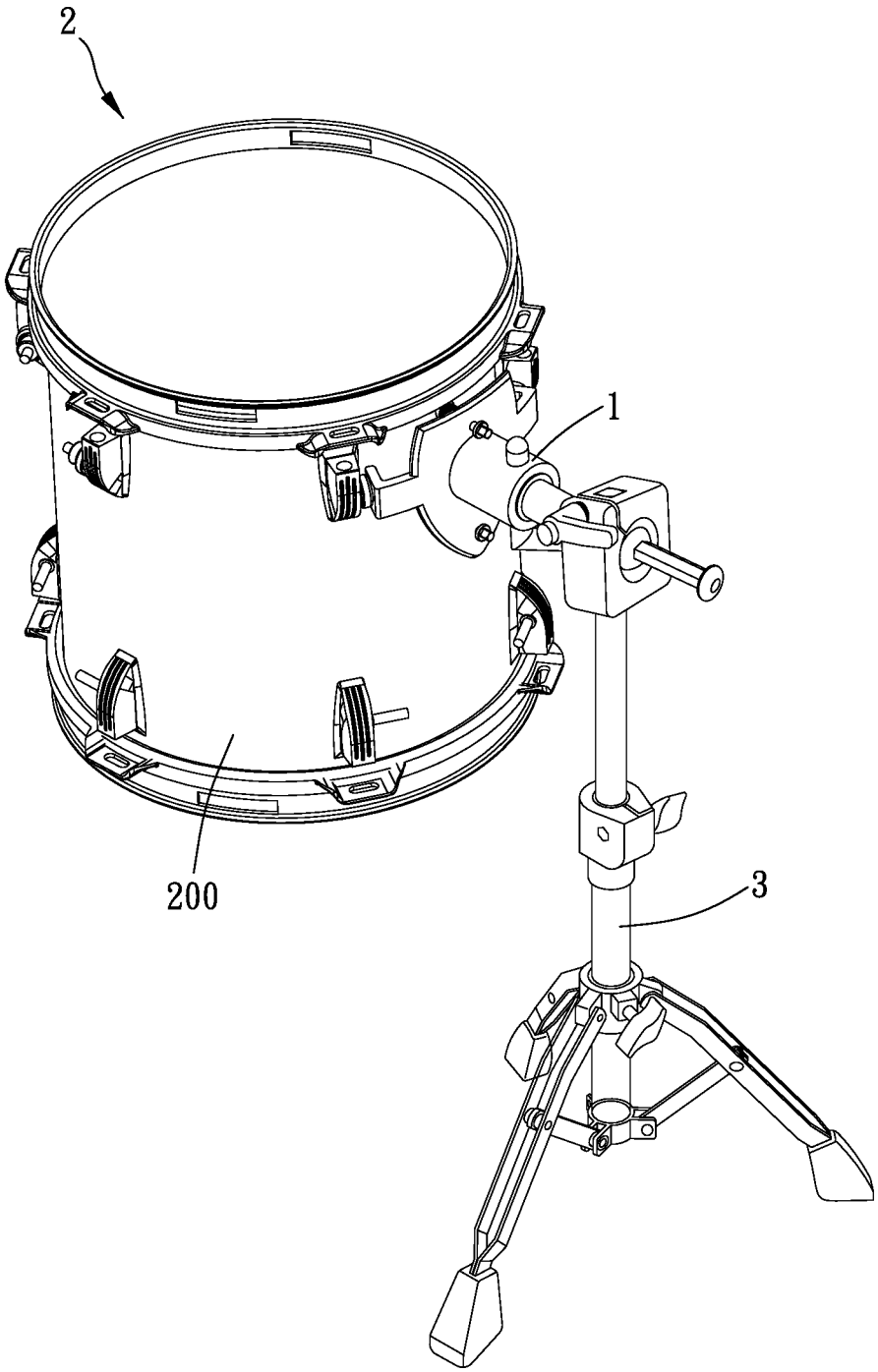
FIG. 7 is a schematic diagram of a preferable embodiment of the present invention in use.

Please refer to FIGS. 1 to 7 for a preferable embodiment of the present invention. A drum stand coupler 1 of the present invention includes a fixing mechanism 10 and a connecting mechanism 20.

The fixing mechanism 10 is configured to be disposed on a drum body 2. The connecting mechanism 20 is rotatably connected with the fixing mechanism 10 and configured to be assembled with a stand 3. Therefore, the drum body 2 is rotatable relative to the connecting mechanism 20 when the drum body 2 is beaten, and the drum stand coupler 1 can stably connect the drum body 2 with the stand 3 and the drum body has good resonance effect.

The fixing mechanism 10 includes at least one fixing member 11 fixedly disposed on the drum body 2, and the connecting mechanism 20 includes a bracket 21 rotatably connected with the at least one fixing member 11. One of the at least one fixing member 11 and the bracket 21 has an assembling convex portion 111, and the other of the at least one fixing member 11 and the bracket 21 has an assembling concave portion 211 rotatably connected with the assembling convex portion 111. In this embodiment, each of the at least one fixing member 11 has one said assembling convex portion 111, and the bracket 21 has the assembling concave portion 211; the assembling convex portion 111 includes a shaft 112 lateral to an axial direction A of the drum body 2 and a sleeving member 113 sleeved on the shaft 112. Each of the sleeving member 113 is disposed between one of the at least one fixing member 11 and the bracket 21, and the assembling concave portion 211 is sleeved to at least one of the shaft 112 and the sleeving member 113. The sleeving member 113 may be made of rubber so as to provide stable assembly. The assembling concave portion 211 includes at least one recession 212 within which the shaft 112 is inserted, and the recession 212 may be a through hole or a blind hole which has a simple structure and is easy to be assembled. However, the assembling concave portion may be disposed on the at least one fixing member, and the assembling convex portion may be disposed on the bracket.

The fixing mechanism 10 includes at least two said fixing members 11, and the bracket 21 includes a first portion 213 connected with the at least two said fixing members 11 and a second portion 214 configured to be connected with the stand 3. The first portion 213 includes a base portion 215, two arm portions 216 extending from two opposite sides of the base portion 215 and two protruding ears 217 respectively connected transitionally with the two arm portions 216. The two protruding ears 217 extend in a direction toward the drum body 2 and are rotatably connected with two of the at least two said fixing members 11, and each of the two protruding ears 217 has one said recession 212 so that the two protruding ears 217 are stably connected with the at least two said fixing members 11 so as to disperse force applied thereon and reduce abrasion of components. The first portion 213 is preferably integrally formed as a single component so as to have preferable structural strength and be easy to manufacture. Please refer to FIG. 4, in this embodiment, the bracket 21 is disposed between adjacent two of the at least two said fixing members 11; as viewed in a thickness direction of the first portion 213, the base portion 215 and the two arm portions 216 extend arcuately, and an angle between each of the two protruding ears 217 and one of the two arm portions 216 is an acute angle, which minimizes a volume occupied by the drum stand coupler 1 and each of the two protruding ears 217 corresponds to one of the at least two said fixing members 11 in a surface contact manner so as to have good assembling stability. However, the bracket may be connected with only one of the at least two said fixing members or two of the at least two said fixing members which are not adjacent to each other.

Specifically, the sleeving member 113 of each said assembling convex portion 111 includes a larger diametric segment 114 close to one of the at least two said fixing members 11 and a small diametric segment 115 connected with the larger diametric segment 114, and each of the two protruding ears 217 is sleeved to one said small diametric segment 115 so as to reduce influence on resonance effect of the drum body 2 and be stably assembled with each other; an end of each said small diametric segment 115 away from one said larger diametric segment 114 has a flange 116 radially disposed thereon, and each of the two protruding ears 217 is located between the larger diametric segment 114 and the flange 116 for stable assembling; an end surface of each said larger diametric segment 114 facing one of the at least two said fixing members 11 has a plurality of grooves 117 radially extending thereon, which reduces contact area between the end surface and one of the at least two said fixing members 11 so that the sleeving member 113 is smoothly rotatable relative to one of the at least two said fixing members 11.

The connecting mechanism 20 further includes at least one abutting member 22 which is disposed on the bracket 21 and protrudes in a direction toward the drum body 2, and each of the at least one abutting member 22 is located at a side of the bracket 21 relative to the at least two said fixing members 11 so as to keep an interval between the bracket 21 and the drum body 2. Each of the at least one abutting member 22 includes a head portion 221 configured to be abuttable against the drum body 2, a body portion 222 connected with the head portion 221 and penetrated through the bracket 21 and an elastic member 223 elastically abutted against and between the head portion 221 and the bracket 21. With structures as described above, when the drum body 2 is beaten, the elastic member 223 is compressed and the drum body 2 is swingable relative to the bracket 21; when the drum body 2 is not beaten, the elastic member 223 stretches and the drum body 2 is swung to its original position. At least part of each of the at least one abutting member 22 is a cushioning member which may be made of rubber, silicone or elastic plastic so as to have good shock absorption effect. Please refer to FIG. 6, in this embodiment, the head portion 221 is a cushioning member and has an extending segment 225 which protrudes in a direction toward the bracket 21 and is connected with the body portion 222, and the elastic member 223 is a coil spring and partially wound around the extending segment 225; preferably, each of the at least one abutting member 22 further includes a washer 226 which is sleeved on the body portion 222 and located between the bracket 21 and the elastic member 223 so as to effectively reduce influence on resonance effect of the drum body 2. An end of the body portion 222 away from the head portion 221 has a projection 224 which protrudes radially therefrom and is blockable with the bracket 21, and the projection 224 and the head portion 221 are respectively located at two opposite sides of the bracket 21. In this embodiment, the body portion 222 is a screw rod which is screwed with the head portion 221, and the projection 224 is a screw head integrally formed in one piece with the screw rod. The projection 224 prevents the at least one abutting member 22 from departing from the bracket 21, and the at least one abutting member 22 has a simple structure and is easy to be assembled, disassembled and adjusted. However, the body portion may be fixedly connected with the head portion; the projection may be a flange, C-shaped retainer or O-ring radially and protrudingly disposed on the body portion; each of the at least one abutting member may be integrally formed as a cushioning member (such as a rubber column formed in one piece). Preferably, two opposite sides of the bracket 21 relative to the at least two said fixing members 11 respectively have one said abutting member 22 so as to avoid over-rotation of the drum body 2.

A drum using the drum stand coupler 1 as described above is further provided, further including: the drum body 2. An interconnection of the fixing mechanism 10 and the connecting mechanism 20 defines a rotating axis R about which the connecting mechanism 20 is rotatable, and the rotating axis R is transverse to the axial direction A of the drum body 2, which allows the drum body 2 to swing after being beaten so as to have good resonance effect. The drum body 2 includes a drum shell 200 defining a resonance space, and the whole drum stand coupler 1 is located at an upper half of the drum shell 200 in the axial direction A. Therefore, the rotating axis R is close to a drumhead of the drum body 2 and moment generated during drumming is reduced, which avoids abrasion of components.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A drum stand coupler, including:

a fixing mechanism, configured to be disposed on a drum body; and a connecting mechanism, rotatably connected with the fixing mechanism and configured to be assembled with a stand;

wherein the fixing mechanism includes at least one fixing member fixedly disposed on the drum body, and the connecting mechanism includes a bracket rotatably connected with the at least one fixing member;

wherein one of the at least one fixing member and the bracket has an assembling convex portion, and the other of the at least one fixing member and the bracket has an assembling concave portion rotatably connected with the assembling convex portion.

2. The drum stand coupler of claim 1, wherein the assembling convex portion includes a shaft lateral to an axial direction of the drum body and a sleeving member sleeved on the shaft, each of the sleeving member is disposed between one of the at least one fixing member and the bracket, and the assembling concave portion is sleeved to at least one of the shaft and the sleeving member.

3. The drum stand coupler of claim 1, wherein the fixing mechanism includes at least two said fixing members, the bracket includes a first portion connected with the at least two said fixing members and a second portion configured to be connected with the stand, the first portion includes a base portion, two arm portions extending from two opposite sides of the base portion and two protruding ears respectively connected transitionally with the two arm portions, and the two protruding ears are rotatably connected with two of the at least two said fixing members.

4. The drum stand coupler of claim 3, wherein as viewed in a thickness direction of the first portion, and an angle between each of the two protruding ears and one of the two arm portions is an acute angle.

5. The drum stand coupler of claim 1, wherein the connecting mechanism further includes at least one abutting member which is disposed on the bracket and protrudes in a direction toward the drum body, and each of the at least one abutting member is located at a side of the bracket relative to the at least one fixing member.

6. The drum stand coupler of claim 5, wherein each of the at least one abutting member includes a head portion configured to be abuttable against the drum body, a body portion connected with the head portion and penetrated through the bracket and an elastic member elastically abutted against and between the head portion and the bracket.

7. The drum stand coupler of claim 6, wherein each of the at least one abutting member further includes a washer which is sleeved on the body portion and located between the bracket and the elastic member.

8. The drum stand coupler of claim 5, wherein at least part of each of the at least one abutting member is a cushioning member.

9. The drum stand coupler of claim 2, wherein each of the at least one fixing member has one said assembling convex portion, the bracket has the assembling concave portion; the assembling concave portion includes at least one recession within which the shaft is inserted; the fixing mechanism includes at least two said fixing members, the bracket includes a first portion connected with the at least two said fixing members and a second portion configured to be connected with the stand, the first portion includes a base portion, two arm portions extending from two opposite sides of the base portion and two protruding ears respectively connected transitionally with the two arm portions, the two protruding ears extend in a direction toward the drum body and are rotatably connected with two of the at least two said fixing members, each of the two protruding ears has one said recession; the bracket is disposed between adjacent two of the at least two said fixing members; as viewed in a thickness direction of the first portion, the base portion and the two arm portions extend arcuately, an angle between each of the two protruding ears and one of the two arm portions is an acute angle; the sleeving member of each said assembling convex portion includes a larger diametric segment close to one of the at least two said fixing members and a small diametric segment connected with the larger diametric segment, each of the two protruding ears is sleeved to one said small diametric segment; an end of each said small diametric segment away from one said larger diametric segment has a flange radially disposed thereon, each of the two protruding ears is located between the larger diametric segment and the flange; an end surface of each said larger diametric segment facing one of the at least two said fixing members has a plurality of grooves radially extending thereon; the first portion is integrally formed as a single component; the connecting mechanism further includes at least one abutting member disposed on the bracket and protruding toward the drum body, and each of the at least one abutting member is located on a side of the bracket relative to the at least two said fixing members; each of the at least one abutting member includes a head portion configured to be abuttable against the drum body, a body portion connected with the head portion and penetrated through the bracket and an elastic member sleeved on the body portion and elastically abutted against and between the head portion and the bracket; the head portion is a cushioning member and has an extending segment which protrudes in a direction toward the bracket and is connected with the body portion, the elastic member is a coil spring and partially wound around the extending segment; an end of the body portion away from the head portion has a projection which protrudes radially therefrom and is blockable with the bracket, the projection and the head portion are respectively located at two opposite sides of the bracket; and each of the at least one abutting member further includes a washer which is sleeved on the body portion and located between the bracket and the elastic member.

10. A drum using the drum stand coupler of claim 1, further including:

the drum body, an interconnection of the fixing mechanism and the connecting mechanism defining a rotating axis about which the connecting mechanism is rotatable, the rotating axis being transverse to an axial direction of the drum body.

11. The drum of claim 10, wherein the drum body includes a drum shell defining a resonance space, and the whole drum stand coupler is located at an upper half of the drum shell in the axial direction.

* * * * *